US008869326B2

(12) United States Patent
Lemmens

(10) Patent No.: US 8,869,326 B2
(45) Date of Patent: Oct. 28, 2014

(54) COMFORT X HAMMOCK

(76) Inventor: Joseph Rene Lemmens, Apex, NC (US)

( * ) Notice: Subject to any disclaimer, the term of this patent is extended or adjusted under 35 U.S.C. 154(b) by 435 days.

(21) Appl. No.: 12/804,167

(22) Filed: Jul. 15, 2010

(65) Prior Publication Data

US 2011/0010849 A1 Jan. 20, 2011

Related U.S. Application Data

(60) Provisional application No. 61/271,264, filed on Jul. 18, 2009.

(51) Int. Cl.
*A47C 21/02* (2006.01)
*A45F 3/22* (2006.01)

(52) U.S. Cl.
CPC ..... *A45F 3/22* (2013.01)
USPC ..... 5/498; 5/120; 5/122

(58) Field of Classification Search
USPC ..... 5/120–123, 125, 89.1, 81.1 T
See application file for complete search history.

(56) References Cited

U.S. PATENT DOCUMENTS

| | | | | | |
|---|---|---|---|---|---|
| 142,327 | A * | 9/1873 | Craft | 5/129 |
| 317,291 | A * | 5/1885 | Brock | 5/123 |
| 375,793 | A * | 1/1888 | Beals | 5/123 |
| 381,863 | A * | 4/1888 | Travers | 5/123 |
| 416,242 | A * | 12/1889 | Sutphen | 5/123 |
| 451,009 | A * | 4/1891 | Adams | 5/123 |
| 492,852 | A * | 3/1893 | Travers | 5/123 |
| 725,475 | A * | 4/1903 | Palmer | 5/123 |
| 2,781,528 | A * | 2/1957 | Lo Vico | 5/122 |
| 3,526,909 | A * | 9/1970 | Kotler | 5/123 |
| 3,606,621 | A * | 9/1971 | Bertsche | 5/122 |
| 4,057,859 | A * | 11/1977 | Setterholm | 5/121 |
| 4,320,542 | A * | 3/1982 | Cohen | 5/121 |
| 5,170,521 | A * | 12/1992 | Light | 5/118 |
| 6,003,173 | A * | 12/1999 | Meoli et al. | 5/120 |
| 6,701,549 | B1 * | 3/2004 | Eriksen | 5/120 |
| 7,546,652 | B1 * | 6/2009 | Maloof et al. | 5/655 |
| 2009/0265851 | A1 * | 10/2009 | Clark | 5/122 |

* cited by examiner

*Primary Examiner* — Robert G Santos
*Assistant Examiner* — Richard G Davis
(74) *Attorney, Agent, or Firm* — Eric Fincham

(57) ABSTRACT

A hammock design which provides increased lifting at its mid-length or medial portion through a combination of wide bands of fabric in a lengthwise X-shaped formation with a curved or bent spreader bar. In a preferred use, the spreader bar rises from a lower middle part toward higher raised ends. This hammock allows the user a comfortable positioning with nearly horizontal transverse support at the users shoulders and a nearly level position from head to toe.

11 Claims, 4 Drawing Sheets

COMFORT X HAMMOCK

CROSS-REFERENCE TO RELATED APPLICATIONS

This application claims priority from provisional U.S. Patent Application 61/271,264, filed Jul. 18, 2009.

BACKGROUND OF THE INVENTION

This invention relates to hammocks, particularly one in which an occupant is supported by material suspended between at least two points. An occupant suspended above the ground in a hammock may rest from a few hours for daytime napping up to a full night sleep in places where the hammock is a substitute for a bed, such as a board ship or in some countries.

Hammocks in general have been used for thousands of years, however most recent improvements appear in the last 100 years.

Prior art patents show different concepts and inventions related to increase level surface, spreader bar improvements, variable tensioning of fabrics, specific fabric shapes and asymmetric position of fabric and spreader bars. Graham's U.S. Pat. No. 645,805, Potter's U.S. Pat. No. 717,119, Hall's U.S. Pat. No. 4,001,902, Fueslein's U.S. Pat. No. 4,021,868, Scott's U.S. Pat. No. 6,347,638, Eriksen's U.S. Pat. No. 6,701,549, Hennessey's U.S. Pat. No. 6,865,757 and Helsdon's U.S. Pat. No. 7,020,915 each show improvements to hammocks. These patents show various ways to achieve some improvement of comfort as less curvature lengthwise for the occupant usually at the detriment of the lateral flatness of the hammock. Some others are keeping the lateral flatness to the detriment of a multi-steep flatness lengthwise.

Most hammock materials used today have a strong longitudinal strength with low elongation of around 2 to 5 percent in that direction which allows a person to lie in the hammock and be well supported, especially if a pre-tension of 20 to 100 lbs is made upon installing the hammock.

Many hammocks are so concave from side to side that any field of vision horizontally is gone and the occupant is constrained to resist a high level of side to side pressure.

A final and important drawback to most patents using only a two-ring support system, is when a higher tension is applied on the rings in order to improve the level lengthwise, a similar decrease of stability is brought about making it nearly impossible to stay on the hammock.

BRIEF SUMMARY OF THE INVENTION

It is therefore a foremost object of this invention to provide a hammock where the supporting surface is substantially level both lengthwise and laterally at the upper body level where the occupant lies on the hammock for pleasure or sleeping purposes.

A second object of this invention is to provide a low cost but sophisticated fabric support system which is easy to use either recreationally or under more tension such as sleeping surface including a three point anchoring design allowing lengthwise level and high stability combined with ease of installation.

A third object of this invention is to provide a fabric structure with two wide bands in an X formation, which supports the weight of the occupant exactly where it is more concentrated, from ⅓ to ⅔ of the hammock in its center as shown later on line force diagram, FIG. 4A.

A fourth object of this invention is to provide improved tensioning including non-linear, curved or bent spreader bars, the positioning of which can provide a near-level surface for the occupant. This elevation of the bar ends, which work similarly as a suspended bridge, allows easy adjustment of the hammock tension, comfort and level degree as desired.

Several other objects and advantages of this invention are to provide lateral stability through double anchoring at one end of the hammock via a single tree or post with a triangle or a spreader block which allows a two point anchoring system; a second way to achieve this stability is to provide one of the spreader bars with two clip-on legs free to rotate and hold either end from leaning side to side.

It is understood that 3 or 4 points anchoring is preferable, when possible. Use of this hammock in a house would preferably be fixed solid at the head with a double short anchoring system which allows tensioning while preserving full stability.

The preferred embodiments of the invention have been described; however, several other embodiments based on the broad designs and configurations of the present invention are contemplated within the scope of the claims presented below.

A first non-illustrated arrangement is the solid attachment of one spreader bar directly onto a bedroom wall, a ship partition or an outdoor hammock support. In such a situation, only one end would require a variable length attachment which can include a one or two ring structure, or not.

Another non-illustrated arrangement of the hammock is where the rectangular fabric flap would be self supporting without any attachment to the spreader bar; in this case, the fabric lateral strength combined with a certain extra length of fabric and an appropriate hem with or without rope into the hem would provide the basic comfort required.

A third arrangement is where the larger diagonal fabric band would include a certain degree of looseness at the location of the head and the feet.

Several other arrangements are possible through using the basic elements of the first embodiment and integrating these into the other embodiments especially the third and fourth.

LIST OF REFERENCE NUMERICALS

Figure 1:
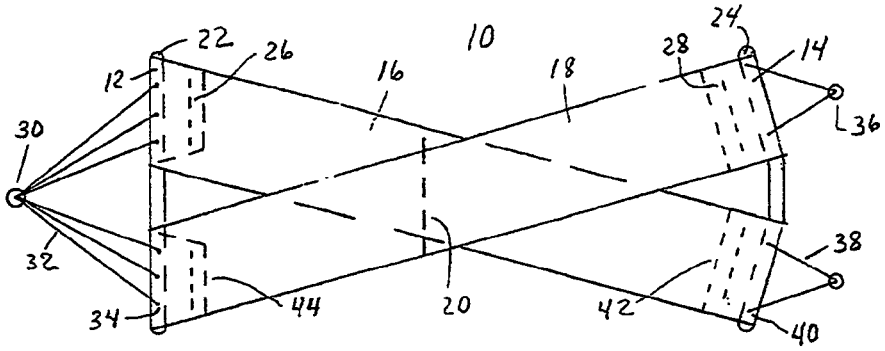
FIG. 1 shows a top view of the hammock which forms the first embodiment when combined with FIG. 2B.

10 single wide hammock 62 sew line
12 spreader bar 64 sew line
14 spreader bar 66 sew line
16 large band of fabric 68
18 large band of fabric 70 force line
20 sew line 72 force line
22 loop 74 force line
24 loop 76 force line
26 sew line 78
28 sew line 80 hammock
30 single ring 82 force line
32 supporting ropes 84 spreader bar
34 anchor holes 86 force line
36 double rings 88 spreader bar
38 supporting ropes 90 force line
40 anchor holes 92 hammock
42 fabric end 93 edges webbing
44 fabric end 94 transversal line
46 material holes 96 spreader bar
48 material holes 97 spreader bar
50 rectangular fabric 98 force lines
52 medium width hem 100 force lines
54 adjustable flap 102
56 sew line 104
58 variable length rope 106
60 fix flap 108
110 ComfortX Hammock 145 two hooks
112 146
113 spreader bar 148
114 spreader bar 150
116 fabric band 152
118 fabric band 154 rectangular fabric
120 sew line 156 flap
122 157 sew line
124 sew line 158 rope
126 sew line 160 flap
128 sew line 161 sew line
130 ring 162 ring
131 ropes 163 an opening
132 ropes 164 sew line
133 ring 166 sew line
134 168
135 rope 170 double wide hammock
136 spaced rings 172 diagonal band
137 lower center holes 172[1] diagonal band
138 series of ropes 173 triangle section
139 tree 174 diagonal band
140 holes 174[1] diagonal band
141 spreader block 175 triangular section
142 176 double curve bar
143 bungee cord 177 four holes
144 178 straight bar
179 series of holes
180 210
182 locking device 212 fabric end
183 tension ropes 214 sew line
184 tension ropes 216 double flap
186 double fabric 218 fabric ends
188 four ropes 219 cut off line
190 two rings 220 sew line
192 collapsible triangle 221 group of ropes
194 two hanging hooks 222 fabric loop
195 recess hub section 224 fabric end
196 two hinges 226 sew line
197 clip-on legs 228 sew line
198 tree 230 series of ropes
200 fourth embodiment 232 sewing line
202 diagonal fabric band
204 diagonal fabric band
206 double bend spreader bar
208 straight spreader bar

DETAILED DESCRIPTION OF THE INVENTION

Figure 2A:
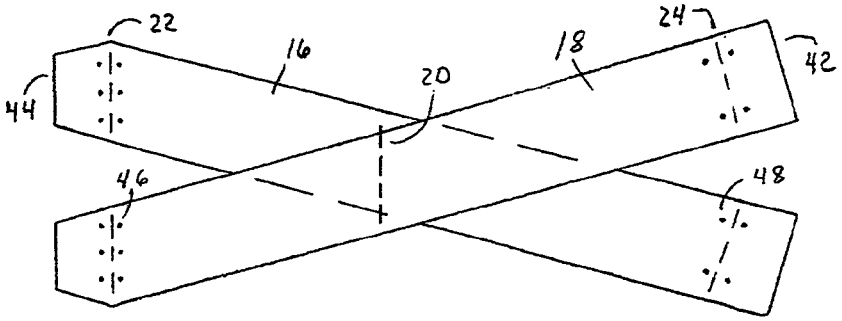
FIG. 2A is a top view of the diagonal fabric bands of FIG. 1.
Figure 2B:
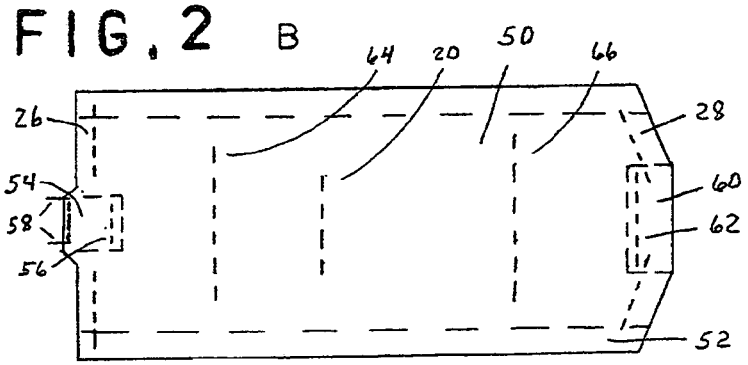
FIG. 2B is a top view of the upper fabric layer fastened to FIG. 1 in order to complete the first embodiment.
Figure 3:
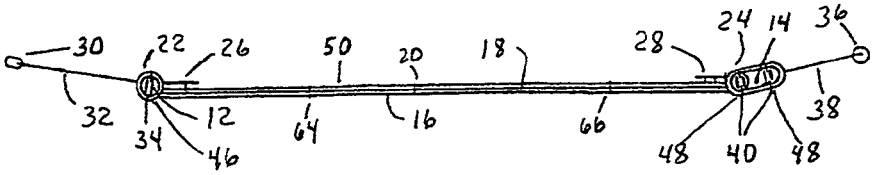
FIG. 3 is a side view of the first embodiment combining FIG. 1 and FIG. 2B.

Referring initially to FIGS. 1-3 described in detail a first embodiment of the present invention in an exploded and side views: FIG. 2B is shown separately of FIG. 1 details in order to provide more clarity to the embodiment description, whereas FIG. 3 is showing the full embodiment as a side view.

In FIG. 1, the Comfort X Hammock is a single wide hammock 10 supported by a spreader bar 12 and 14 supporting two large bands of fabric 16 and 18 in a double diagonal position (making an X shape) providing approximately 70 to 100% of the lifting load of the hammock. The fabric 16 and 18 is fastened at its ends by making a loop 22 and 24 around the spreader bars 12 and 14 and being sewn to itself at line 26 and 28; the lateral movement of the fabric is prevented by a series of supporting ropes 32 and 38 which goes through both the fabric 16 and 18 and bars 12 and 14 through a series of anchor holes 34 and 40. In this first embodiment the ropes 32 are secured to a single ring 30 suitable for attachment to a fixed object; at the other end of the hammock, the support ropes 38 are fastened to a double rings 36 in order to provide extra stability to the hammock and form a three point suspension or simply to have the diameter of a tree acting as a stability factor.

As best seen in FIG. 2, the fabric band 16 and 18 at loop 24 is pulling in a straight line (90 degrees) with the fabric, therefore minimum or no lateral force is involved at the loop line 24 and fabric holes 48; this is the reason why the spreader bar 14 has a double bend of approximately 15 degrees each in order to take maximum advantage of the straight line high strength and low stretching yield fabric use for this hammock.

The straight spreader bar 12 can achieve an acceptable tensioning of the fabric at loop 22 and through a series of fabric holes 46 as shown in FIGS. 1 and 2A; however, the near 15 degrees of side pull result is that the fabric will try to slide towards the center of the hammock; therefore, the number of fabric holes and securing ropes through the spreader bar will need to be increased. Both fabrics 16 and 18 lengthwise end at line 42 and 44 also seen in FIG. 1.

Described in FIG. 2B is an upper rectangular fabric 50, this fabric is also a low yield stretching material in order to complement the diagonal band and support approximately 30% of the occupant's weight; it also gives a complete bedding to support the arms, head, and feet of the user. On each side of this fabric 50 is a medium width hem 52 sewn to itself and to fabric 16 and 18 at each ends. The strongest tension in fabric 50 is at sewing lines 26 and 28 to the fabric band 16 and 18. An adjustable flap 54 sewn to itself at 56 is supported by a variable length rope tie to the spreader bar 12. At the other end a fix flap 60 is sewn to itself at line 62 and provide a more level and comfortable support position for the user. Additional strengthening of the hammock bedding is provided by the sewing lines 20, 64, and 66 which prevents the diagonal band 16 and 18 from shifting laterally under tension when the hammock is in active use.

FIG. 3 is showing a side view of the combination of FIGS. 1 and 2B where the upper fabric 54 lays on top of the diagonal band 16 and 18, all sewn together at 26, 28, 20, 64, and 66; the fabric 16 and 18 is shown making a loop around spreader bar 12 and 14 which are tied to ring 30 and 36 by the rope 32 and 38 passing through the spreader bar at holes 34 and 40 and the material holes 46 and 48. As it could be seen in this side view the double angle bar 14 is laying in a near horizontal position since the rope 38 is free to equalize the tension between the outer and the inner attachment holes 40.

The spreader bars are either made of wood which permit to easily provide drilled holes for the fastening of the ropes and the fabric supporting the load of the hammock. The double angle bar shown in this first embodiment is also easily done with wood since vapor bend wood is intensively used in building furniture and presents a low-cost eco-friendly and strong component as a multi-curve spreader bar. Choice of other materials such as steel or aluminum tubing can also be used, these materials would require the insertion of hollow thin material type rivets in order to form abrasion, and sharp edged free anchoring holes. Composite material such as fiberglass could also qualify, but same as metal it would present a cost and manpower handicap over a wood bar with only a small gain in lightness, appearance, and durability.

Figure 4A:
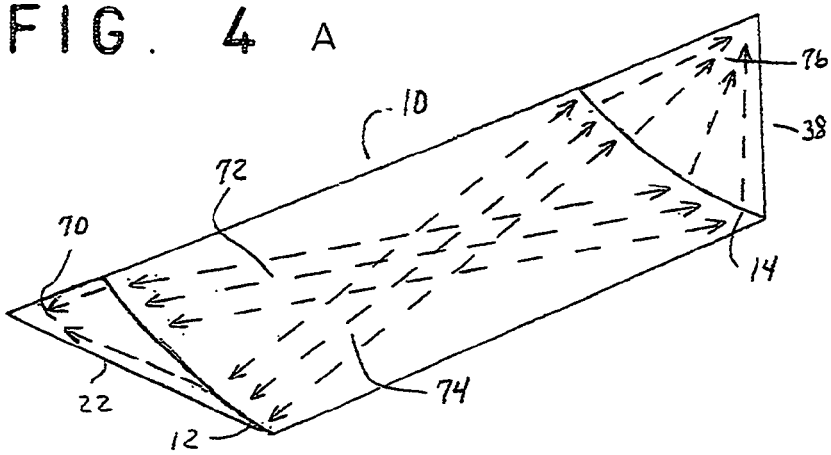
FIG. 4A is a perspective view of the line of force acting in between support, spreader and fabric of the 1st embodiment.

Referring to FIG. 4A the perspective drawing shows the lines of force going through the basic embodiment of the invention with force line 72 and 74 going across each other at 30 to 35 degrees and transmitting the load to the spreader bar 12 and 14, then the line force 70 and 76 are being carried by ropes 22 and 38.

This diagonal flow of the line force is the reason the embodiment permits this level of longitudinal and transversal support where previous hammock failed since near all fabrics strength is straight and cross-wise at 90 degrees.

Figure 4B:
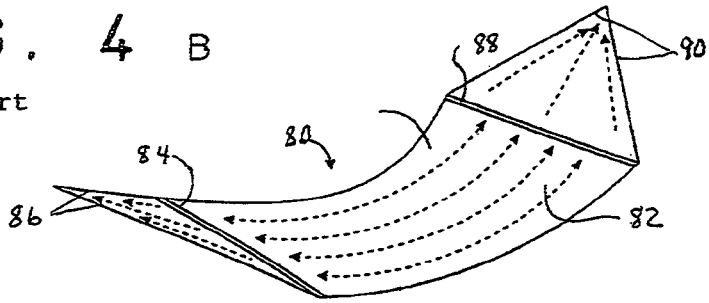
FIG. 4 B Prior Art
FIG. 4B is a perspective view of a prior art line of force.

FIG. 4B is a schematic of the parabolic force lines of a hammock of prior art as shown in the literature; the hammock 80 has force line 82 tied to spreader bar 84 and 88 and is supported by force line 86 and 90 representing the ropes and rings.

Figure 4C:
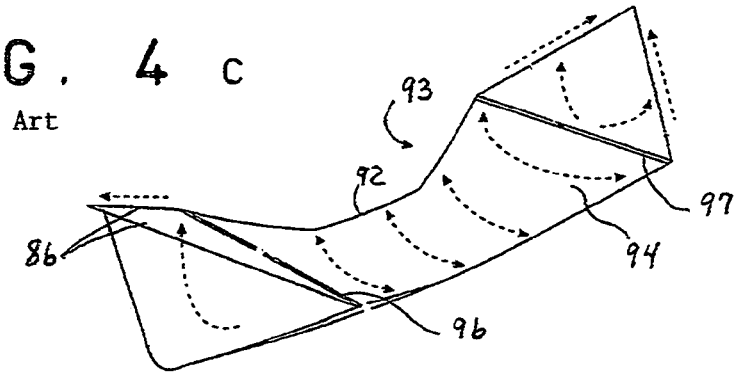
FIG. 4 C Prior Art
FIG. 4C is a perspective view of another more recent prior art showing the line of force.
Figure 4D:
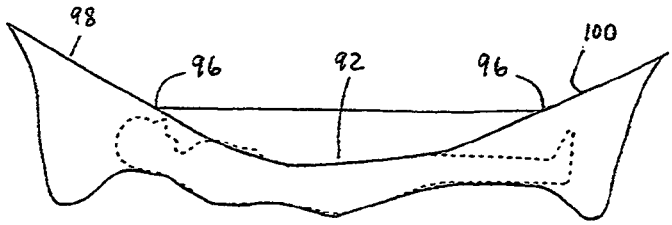
FIG. 4 D Prior Art
FIG. 4D is a side view drawing of a photograph taken from a prior art patent 4C.

FIGS. 4C and 4D show a more recent prior art which uses a combination of outer edge support webbing and transversal strength of the fabric in order to achieve a more level support of the users. In this schematic of the support line of hammock 92, the fabric transversal line 94 is transmitting the support action to the edges webbing 93, and spreader bars 96. Spreader bars 96 and 97 are ties to ropes and rings represented by force lines 98 and 100. It can be seen that the combined concavity of webbing 93 and transverse fabric line 94 allow, for a level longitudinal levelling at the drawback of being enclosed into a deep transversal cocoon which does not provide much or any amount of comfort and relaxation.

FIG. 4D is showing more specifically that the user of the prior art 4C is laying near level lengthwise; however as it can be seen, the fabric is surrounding his body near completely, which means the user's shoulders are forced into a round support position which is similar to the "banana hammock" or laying in the bottom front or rear of a canoe; this and the near total cut-off of peripheral vision is the extreme opposite of what a comfortable relaxing outdoor enjoyment could be.

Figure 5:
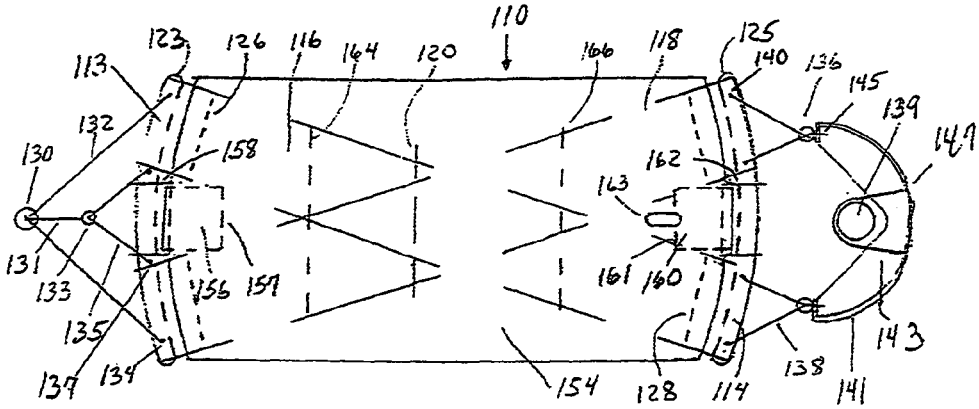
FIG. 5 is a top view of preferred and second embodiment of the Comfort X Hammock.
Figure 6A:
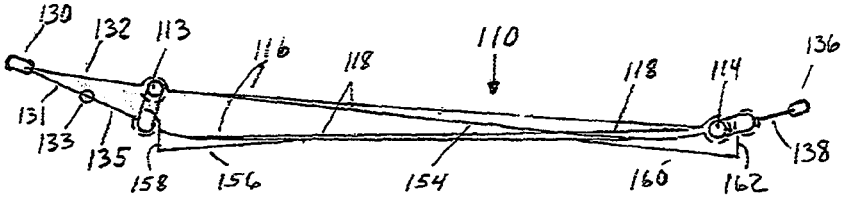
FIG. 6A is a side view of the second embodiment shown in an unloaded position.

FIG. 5 detailed the preferred embodiment of the Comfort X hammock 110 where a spreader bar 114 is built with a single bend having an approximate radius of five feet in order to promote a near perfect pull onto a fabric band 116 and 118; a second spreader bar 113 is also made with a single bend radius of only three to four feet because this bar holds a vertical position as seen in FIG. 6A, and therefore only a partial part of the bend is given for the fabric alignment. Similarly, as in FIG. 1, the fabric band 116 and 118 looped around bars 113 and 114 and sewn to itself, covering the diagonal fabric band is a rectangular fabric 154 at a sew line 126 and 128. Each end of the fabric 154 includes a flap 156 and 160 looped around a rope 158 and 162 sews to itself at 157 and 161; the ropes 158 and 162 are tied around the spreader bars 113 and 114. These flaps are located for the head and the feet, are adjustable by tightening or loosening the ropes 158 and 162. The spreader bar 113 is supported by a ring 130 via a series of ropes 132 tied to the upper ends of bar 113 and another rope 131 which is adjustable at ring 133 which carries the load of the lower center holes 137 via the rope 135. The reason for the separate and adjustable ropes support system is in order to be able to "dial" how much support the occupant wants for the lower back or the upper body. Spreader bar 114 is supported at the other end by a series of ropes 138 looped into the widely spaced rings 136 to hold onto a tree 139 which holds spreader block 141 which has two hooks 145 anchoring the rings 136. The hammock 110 also provides, through fabric 154 an opening 163 which allows the occupant to lay face down and breathe easily with the head and body in line.

FIG. 6A is a side view of FIG. 5 of the preferred embodiment of the invention; the hammock is shown in a relaxed position with fabric band 116 and 118 edges in a near straight line position; fabric 154 follows a more convolute shape since the outer edges of band 116 and 118 are located 4 to 6 inches higher than their inner edges at the spreader bar 113 and then they criss-cross each other before they reach the other end at spreader bar 114, therefore developing a staggered lift especially strong from ⅓ to ⅔ the length of the hammock bed.

Supporting the spreader bar 113 is the ring 130 with ropes 132 tied to the upper end of the bar 113 and the rope 131 and 135 via ring 133 tied to the lower center section of the curved bar 113. At the other end of the hammock, the ropes 138 are tied to the rings 136 at one end and through holes 140 through fabric band and spread bar 114. Side views provide a precise view of how a flap 156 is linked to the spreader bar with a rope 158. Same scenario at the other end with a flap 160 supported at its end by a rope 162 tied to the spreader bar 114.

Figure 6B:
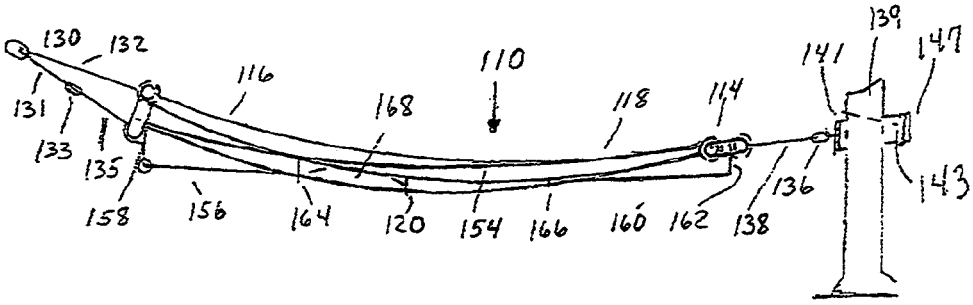
FIG. 6B is the same as FIG. 6A except it is loaded (i.e. with an occupant).

The side view FIG. 6B is showing the same hammock as loaded by an occupant (not shown), and is based on the testing of several prototypes. The description is similar as FIG. 6A except that the loaded diagonal bands 116 and 118 are now lower by six to eight inches which is about only one-half what a current hammock does as in FIG. 4B under a same occupant weight.

As seen in FIG. 6A, the two flaps are around three to four inches lower than the bedding, now under load as shown in FIG. 6B, the two flaps are now nearly horizontal with the whole bedding and provides a near level surface from feet to head.

The two point support at rings 136 can be provided by a single tree with the spreader block 141 made of wood reinforced with an outer strap or wire of metal tie to the front hooks 145. The bungee cord 143 is used to hold the block 141 during the initial set-up, only because once the hammock is under a tension of two to four hundred pounds, the block then is stable by friction to a very high degree.

Figure 7:
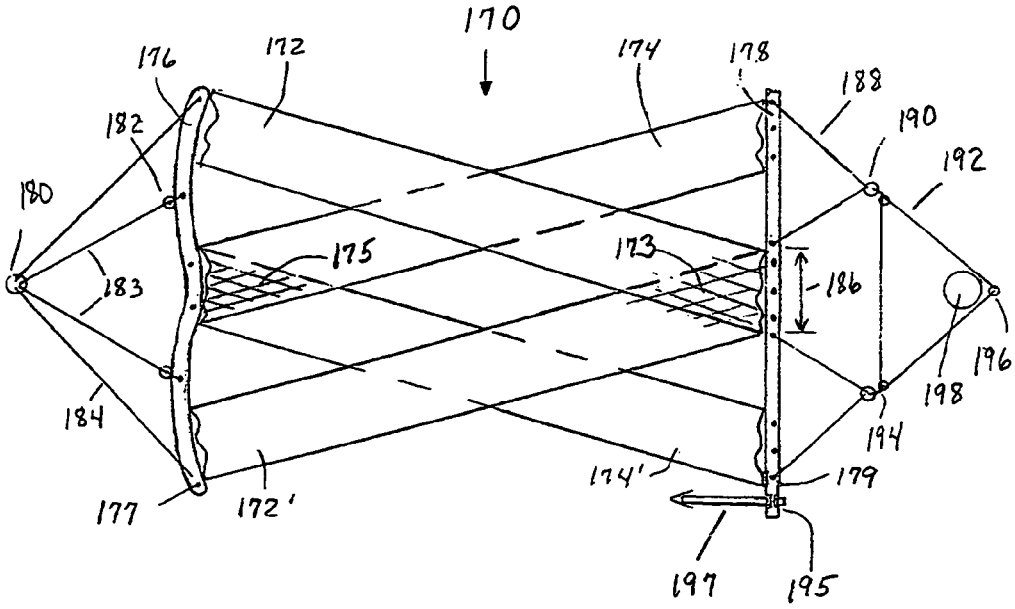
FIG. 7 shows a top view of a double wide hammock made compact by overlapping the diagonal fabric band at the center of the hammock.

FIG. 7 is showing a third embodiment of the invention as a partial top view of a double wide Comfort XX hammock as 170; in this hammock, the upper rectangular fabric is omitted in order to allow more clarity of the lower diagonal bands which are shown as a cut-off section for the same reason. This embodiment shows a first diagonal band 172 which forms a wide X with a second diagonal band 174; a second wide X is formed by a third diagonal band 172' crossing over a fourth diagonal band 174'. Both bands 172 and 172' overlap at a triangular section 173, therefore reducing the width of the hammock; similarly, the bands 174 and 174' overlap at a triangular section 175.

Other components of the hammock have similar characteristics as previous embodiment such as a double curve spreader bar 176 similar to bar 113 of FIG. 5, and a straight spreader bar 178 which provides the same function as spreader bars 12, 14 and 114 since all those bars are positioned in a horizontal plane including the curved section in bar 114. It should be noted that the horizontal plane bar end of the hammock is preferred for the flatter fabric area it provides for the upper body of the user. This third embodiment is supported by a single ring 180 which supports a series of tension ropes 183 and 184; the ropes 183 are adjustable near spreader bar 176 thru a locking device 182, all ropes tie to bar 176 and a series of four holes 177.

At the other end the hammock is supported by bar 178 and a series of holes 179 with four ropes 188 tied to the two rings 190. Located around a tree 198, is a collapsable triangle 192; this allows two hanging hooks 194 to carry the pull of the hammock and a rigid two point support. The triangle 192 has at least 2 hinges 196 and can be built from tubing material and locked at the third intersection with its hook 194.

An alternative method to provide roll stability is to provide the hammock with two clip-on legs 197 fastened to a recess hub section 195 as part of bar 178.

Figure 8:
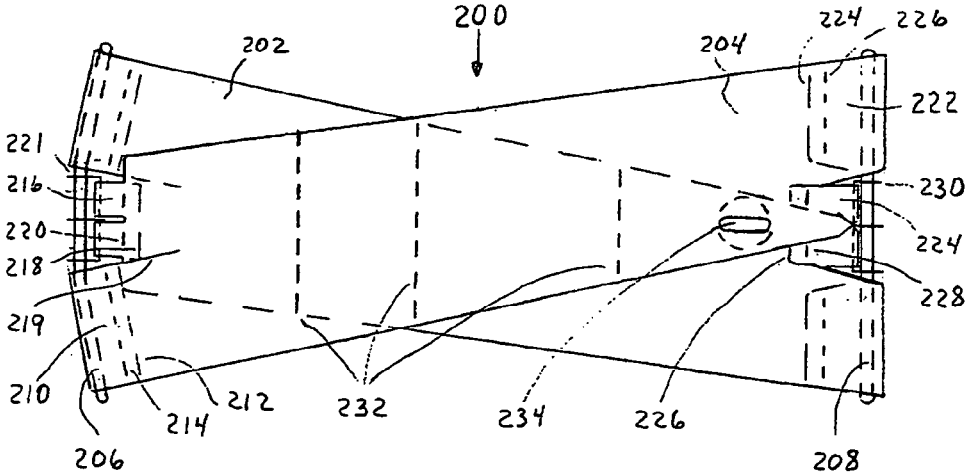
FIG. 8 is a schematic view of a third embodiment built with only two pieces of fabric.

FIG. 8 is a fourth embodiment 200 of the Comfort X hammock and is shown as an alternative and lower cost two diagonal fabric bands 202 and 204 slightly wider than in previous embodiment; this configuration eliminates the need for the upper rectangular fabric. This partial embodiment shows a double bend spreader bar 206 around which the fabric 202 and 204 looped around with fabric end at 212 and sewn to itself at line 214. At mid-width, a double flap 216 from fabric 202 and 204 is looped around itself up to end 218 and sewn to itself at sew line 220; a cut off line 219 gives some leeway into the amount of sag provided by a group of ropes 221.

At the center of the diagonal band a few sewing line 232 provides extra strength and stability to the fabric, it also allows a precise location for under knee pillow lift. The hammock's other end is shown with a straight spreader bar 208 with fabric loop 222 ending at 224 and sewn at line 226; center section is similar to the other end with a single layer of fabric 204 and 202 forming a flap 224 before reaching bar 208, this fabric loop end at 226 and is sewn at line 228; a series of ropes 230 are fastening the flap to the bar 208. A breathing hole 234 and surrounding sewing allows for face down use of the hammock.

Fabrication and assembly of this hammock is basic wood working, fabric cutting, sewing, and mostly manual assembly of the components together. Pre-production hammocks should be made in order to eliminate any production difficulty and reach a product with the correct characteristics. Assembly of the 2 or 3 layers of fabric will need to be precise enough in order to achieve shared load and stretch lengthwise but give approximately 5% extra material near the flap area at each end from side to side; this extra material is important as it permits a level support of the hammock occupant.

It is useful to note that these specific details to the invention embodiments are already known by the persons familiar with the construction of hammock structure and construction.

The many advantages which are inherent to the embodiments structure are obvious to the one skilled in the art. Those embodiments are described herein illustratively and are not meant to limit the scope of the invention, therefore variation of the basic embodiments is intended to be encompassed by the following claims.

The invention claimed is:

1. A hammock comprising:

first and second bands of material, first and second spreader bars located at opposite ends of said hammock, said first band of material extending from a first end of said first spreader bar to proximate a second end of second spreader bar, said second band of material extending from proximate a second end of said first spreader bar to another diagonally opposite second spreader bar end portion, said first and second bands of material being secured to said first and second spreader bars, each of said bands of material having a width equal to approximately one third of the width of the hammock;

one of said spreader bars being non linear; and a cover material secured to said two bands of material.

2. The hammock of claim 1 wherein each of said bands of material has a width equal to approximately one third of the width of the hammock, respective ends of each of said diagonal bands of material having a loop formed thereat to receive said spreader bars.

3. The hammock of claim 1 wherein at least one end of said hammock is supported by a double connecting means pulling outwardly from the spreader bar towards two supporting structure points.

4. The hammock of claim 1 wherein at least one end of the cover material includes a middle flap portion with level adjustment means for allowing raising and lowering of the cover material for adjustably supporting the head or feet of the occupant in a level manner.

5. The hammock of claim 1 including control rope means for adjusting the orientation of said one spreader bar from a more upwardly extending position to a less upwardly extending position.

6. The hammock of claim 1 wherein each of said spreader bars is rigid.

7. The hammock of claim 1 wherein said bands of material are formed at an angle of approximately 30 degrees between each other.

8. The hammock of claim 1 wherein each of the diagonal bands of material having a width dimension of approximately one third of the width of the hammock bed and having a length dimension approximately two to three percent shorter than the bed sheet for material of equivalent stretch level such as cotton, polyester or similar fabric.

9. The hammock of claim 1 wherein said non linear spreader bar has end portions extending upwardly from a middle portion of the bar to opposite ends of the bar thus providing a lift of the diagonal bands higher than the middle portion of the bar at mid length between the two spreader bars.

10. The hammock of claim 1 including third and fourth diagonal bands of material, said first, second, third and fourth bands of material creating two wide side-by-side X shapes at least partially overlapping each other.

11. The hammock of claim 10 further including control rope means for adjusting the orientation of said one spreader bar from a more upwardly extending position to a less upwardly extending position.

* * * * *